US011230832B2

(12) United States Patent
Luettgen

(10) Patent No.: US 11,230,832 B2
(45) Date of Patent: Jan. 25, 2022

(54) TOILET SYSTEM

(71) Applicant: Kohler Co., Kohler, WI (US)

(72) Inventor: Michael J. Luettgen, Grafton, WI (US)

(73) Assignee: Kohler Co., Kohler, WI (US)

( * ) Notice: Subject to any disclaimer, the term of this patent is extended or adjusted under 35 U.S.C. 154(b) by 113 days.

(21) Appl. No.: 16/554,296

(22) Filed: Aug. 28, 2019

(65) Prior Publication Data

US 2020/0071920 A1 Mar. 5, 2020

Related U.S. Application Data

(60) Provisional application No. 62/724,956, filed on Aug. 30, 2018.

(51) Int. Cl.
*E03D 5/10* (2006.01)
*E03D 1/30* (2006.01)
*E03D 11/13* (2006.01)

(52) U.S. Cl.
CPC ..... *E03D 5/105* (2013.01); *E03D 1/30* (2013.01); *E03D 11/13* (2013.01)

(58) Field of Classification Search
CPC ..... E03D 11/02; E03D 11/18; E03D 2001/147–148; E03D 2001/30; E03D 3/12; E03D 5/10–105; E03D 5/12
See application file for complete search history.

(56) References Cited

U.S. PATENT DOCUMENTS 2,813,274 A 11/1957 Lewis et al.
5,133,089 A * 7/1992 Tsutsui ..... E03D 5/10 4/300
6,067,673 A 5/2000 Paese et al.
6,250,601 B1 6/2001 Kolar et al.
8,185,977 B2 * 5/2012 Seibt ..... E03F 1/006 4/431
9,834,918 B2 12/2017 Veros et al.
9,920,510 B2 * 3/2018 Hall ..... E03D 11/02
9,927,302 B1 3/2018 Hall et al.
9,957,705 B2 * 5/2018 Hall ..... A61B 10/0038
2006/0096017 A1 * 5/2006 Yamasaki ..... G01F 23/00 4/420
2017/0191859 A1 7/2017 Hall et al.
2017/0247871 A1 8/2017 Mukerji et al.
2018/0010322 A1 * 1/2018 Grover ..... G01F 23/2962
2018/0030710 A1 * 2/2018 Hall ..... E03D 9/10

* cited by examiner

*Primary Examiner* — David P Angwin
*Assistant Examiner* — Nicholas A Ros
(74) *Attorney, Agent, or Firm* — Lempia Summerfield Katz LLC

(57) ABSTRACT

A tankless toilet system includes a tankless toilet and a sensor. The tankless toilet is configured to receive water from a water source. The tankless toilet includes a bowl, a first supply conduit, a rim jet, a sump, a second supply conduit, and a sump. The first supply conduit is configured to receive the water from the water source. The rim jet is fluidly coupled to the first supply conduit and configured to provide the water to the bowl. The sump is configured to receive the water from the bowl. The second supply conduit is configured to receive the water from the water source separate from the first supply conduit. The sump jet is fluidly coupled to the second supply conduit and configured to provide the water to the sump. The sensor is coupled to the tankless toilet.

14 Claims, 2 Drawing Sheets

TOILET SYSTEM

CROSS-REFERENCE TO RELATED PATENT APPLICATION

This application claims the benefit of and priority to U.S. Provisional Patent Application No. 62/724,956, filed Aug. 30, 2018, the entire disclosure of which is incorporated herein by reference.

BACKGROUND

The present disclosure relates generally to toilet systems. More specifically, the present disclosure relates to a tankless siphonic toilet including a sensor and a control system that can allow for selective and automatic control of the amount of water used by the toilet to perform a flush function.

SUMMARY

At least one embodiment relates to a toilet system. The toilet system includes a tankless siphonic toilet, a first valve, a second valve, a sensor, and a control system. The first valve is configured to control a flow of water from a water source to a rim jet of the tankless siphonic toilet. The second valve is configured to control a flow of water from the water source to a sump jet of the tankless siphonic toilet. The sump jet is configured to prime a siphon for the toilet to perform a flush function. The sensor is operatively coupled at the sump of the toilet below a normal water level of the toilet before a flush is initiated. The first valve, the second valve, and the sensor are each operatively coupled to the control system. The sensor is configured to detect the presence of water within the bowl during a flushing cycle, and to send a signal to the control system when a siphon of the toilet breaks and the contents of the bowl are substantially cleared. The control system is configured to control operation of the second valve in response to the signal received from the sensor.

One embodiment is related to a tankless toilet system. The tankless toilet system includes a tankless toilet and a sensor. The tankless toilet is configured to receive water from a water source. The tankless toilet includes a bowl, a first supply conduit, a rim jet, a sump, a second supply conduit, and a sump. The first supply conduit is configured to receive the water from the water source. The rim jet is fluidly coupled to the first supply conduit and configured to provide the water to the bowl. The sump is configured to receive the water from the bowl. The second supply conduit is configured to receive the water from the water source separate from the first supply conduit. The sump jet is fluidly coupled to the second supply conduit and configured to provide the water to the sump. The sensor is coupled to the tankless toilet and configured to detect a first capacitance value when a first amount of the water is in the sump and a second capacitance value when a second amount of the water is in the sump.

Another embodiment is related to a method of operating a tankless toilet system having a toilet bowl, a rim jet, a sump jet, a sump, a first valve fluidly coupled to the rim jet, a second valve fluidly coupled to the sump jet, a sensor, and a control system operatively coupled to the first valve, the second valve, and the sensor. The method includes detecting, by the sensor, a first capacitance value when a first amount of water is in the sump. The method also includes opening, by the control system and in response to the sensor detecting the first capacitance value, the first valve to cause water to flow from the rim jet to the toilet bowl. The method also includes closing, by the control system and after opening the first valve, the first valve. The method also includes opening, by the control system and after closing the first valve, the second valve to cause water to flow from the sump jet to the sump. The method also includes detecting, by the sensor and after opening the second valve, a second capacitance value when a second amount of water is in the sump. The method also includes closing, by the control system and in response to the sensor detecting the second capacitance value, the second valve.

Another embodiment is related to a system for a toilet having a toilet bowl, a rim jet, a sump jet, and a sump. The system includes a first valve, a second valve, a sensor, and a control system. The first valve is configured to be fluidly coupled to the rim jet. The second valve is configured to be fluidly coupled to the sump jet. The second valve is operable between a first position and a second position. The second valve is configured to facilitate flow of the water from the sump jet to the bowl in the first position and prohibit flow of the water from the sump jet to the bowl in the second position. The sensor is configured to be coupled to the sump and detect a first capacitance value when a first amount of water is in the sump and a second capacitance value when a second amount of water is in the sump, the second amount of water being less than the first amount of water. The control system is operatively coupled to the first valve, the second valve, and the sensor. The control system is configured to cause the second valve to transition from the first position to the second position in response to the sensor detecting the second capacitance value.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
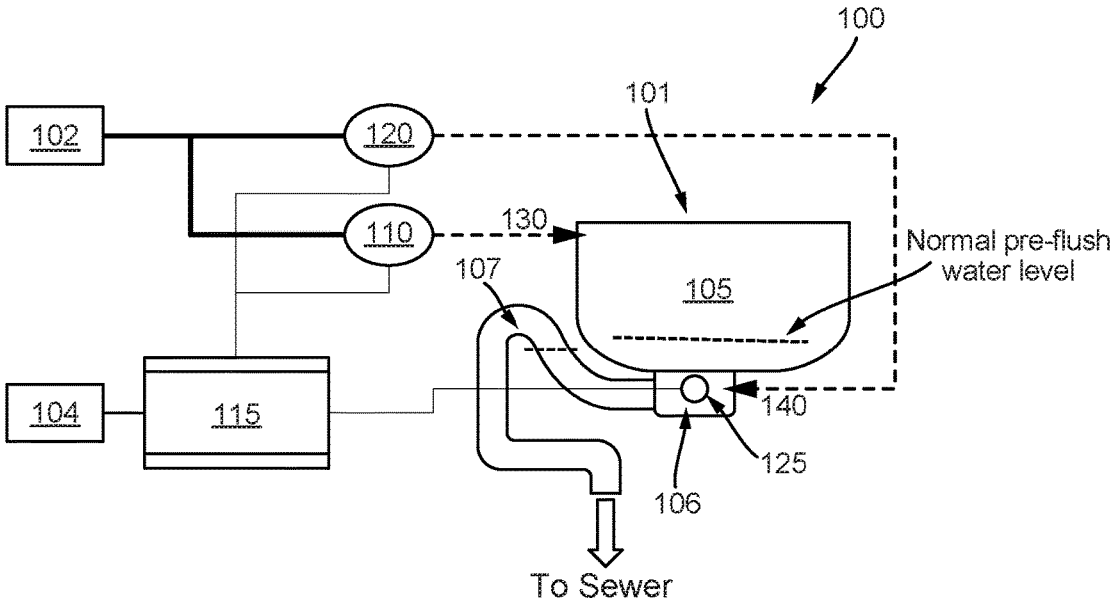
FIG. 1 is a schematic illustration of a toilet system according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Generally speaking, most household toilets include a flush valve that relies on gravity and buoyancy to control the amount of water used during a flush cycle (e.g., a flapper valve, etc.). For example, most flush valves are designed such that when the valve is opened in response to actuation of a flush actuator (e.g., a toilet trip lever, etc.), the valve stays open for a predetermined period of time due its buoyancy, to thereby allow a predetermined amount of water to enter the toilet bowl and clear the contents of the bowl. In these types of systems, however, roughly the same amount of water is used during any given flush cycle regardless of the amount of water actually required to clear the contents of the bowl. That is to say, most flush valves are designed based on a predicted amount of water required to perform a flush cycle.

In an effort to reduce water usage, some toilets include a "dual flush" mechanism that includes two different flush modes for a user to choose from. For example, a dual flush mechanism typically includes a first actuator that allows for a user to perform a flush cycle using a full volume of water (e.g., by fully opening the flush valve, etc.), and a second actuator that allows for a user to perform a flush cycle using a reduced volume of water (e.g., by partially opening the flush valve, etc.). These systems, however, require active input from a user to effectively conserve water (i.e., the user must decide which actuator to select to perform a flush cycle). In addition, these systems are limited to only two particular flush volumes for a given flush cycle.

Thus, it would be advantageous to provide a toilet system that can reactively control the amount of water required to clear the contents of the bowl for a given flush cycle without any input or decisions from a user, so as to more effectively conserve water usage. In addition, it would be advantageous to apply such a system to a tankless toilet that relies on a siphon effect to perform a flush function (referred to herein as a "tankless siphonic toilet").

Referring generally to the figures, disclosed herein is a toilet system including a tankless siphonic toilet that automatically determines and uses only the minimum amount of water necessary to clear the contents of the toilet bowl for a given flush cycle, so as to more effectively reduce water usage, as compared to conventional toilet systems. The disclosed toilet system includes a sensor that detects the presence of water in the sump and/or a portion of the trapway of the toilet during a flush cycle. The sensor can send a signal to a control system that is indicative of whether or not the flush cycle has been completed (i.e., whether or not the siphon has "broken" and the bowl contents have cleared). In response, the control system can control one or more fluid control valves that provide water to the toilet for inducing the siphon and clearing the bowl (e.g., to a sump jet of the toilet, etc.), so as to provide only the necessary amount of water to clear the contents of the bowl for a given flush cycle.

In addition, the disclosed system is configured such that the toilet can continue to receive water at the sump jet to clear the contents of the bowl until a maximum allowable water flush volume has been reached, so as to further conserve water usage. In this manner, the toilet system can help to comply with applicable building codes, and can act as a failsafe to prevent excess water usage in the event of a sensor failure.

Referring to FIG. 1, a toilet system 100 is shown according to an exemplary embodiment. The toilet system 100 includes a toilet 101, shown as a tankless siphonic toilet. The toilet 101 includes a bowl 105, a sump 106 extending below the bowl 105, and a trapway 107 extending from the sump 106 toward a sewer outlet. The toilet 101 further includes a rim jet 130 coupled to an upper portion of the bowl 105, and a sump jet 140 coupled to the sump 106. The rim jet 130 is fluidly coupled to the bowl 105 through a supply conduit extending from a first valve 110 (e.g., an electronic fluid control valve, etc.). The sump jet 140 is fluidly coupled to the sump 106 through a supply conduit extending from a second valve 120 (e.g., an electronic fluid control valve, etc.). The first valve 110 and the second valve 120 are each fluidly coupled to a water supply source 102, such as a normal household water supply line. The first valve 110 and the second valve 120 are also operatively coupled to a control system 115. The first valve 110 and the second valve 120 are configured to control the amount of water provided by the water supply source 102 to the rim jet 130 and the sump jet 140, respectively, so as to perform a flush cycle. According to various exemplary embodiments, the toilet 101 and/or the sump jet 140 can be configured as any one of, or a combination of, the toilet and/or sump jet configurations disclosed in U.S. patent application Ser. No. 15/414,576, titled "LINE PRESSURE-DRIVEN, TANKLESS, SIPHONIC TOILET," the entire disclosure of which is hereby incorporated by reference herein.

In one embodiment, the trapway 107 is configured such that a siphon is created in the trapway 107 as water from the sump jet 140 flows into the sump 106, so as to clear the contents of the bowl 105. The strong water flow created by the sump jet 140 can act to quickly drain the fluids and/or waste from the bowl 105 toward the trapway 107 and the sewer. When substantially all of the contents from the bowl 105 have been drained, the siphon in the trapway 107 is broken as air enters the empty bowl 105 and is directed into the trapway 107, at which point the flush cycle is completed. The rim jet 130 can then be operated to refill the bowl 105 with water to perform a new flush cycle.

Still referring to FIG. 1, the toilet system 100 includes a sensor 125 coupled to the tankless siphonic toilet 101 at the sump 106 below the normal water level within the bowl 105. According to another exemplary embodiment, the sensor 125 is coupled to a portion of the trapway 107 that is below the normal water level before a flush cycle is initiated. According to an exemplary embodiment, the sensor 125 is a capacitive sensor. According to other exemplary embodiments, the sensor 125 is an optical sensor, an ultrasonic sensor, a float sensor, or any other sensor that is capable of detecting the presence of water within a portion of the toilet (e.g., bowl, sump, trapway, etc.). According to an exemplary embodiment, the sensor 125 is a capacitive sensor that is coupled to an exterior portion of the sump 106, such as along a lower exterior surface of the sump 106 (e.g., at the bottom of the sump 106, etc.). In this manner, the sensor 125 is free from any potential contamination from inside the sump 106, and is substantially out of sight from a user/installer, thereby reducing the possibility of mishandling or further contamination. According to an exemplary embodiment, the thickness of the wall of the sump 106 where the sensor 125 is located is in the range of about 10 mm to about 12 mm, so as to allow for sufficient capacitive detection of water through the sump 106 (e.g., if the sump 106 is made from a vitreous material). The thickness of the vitreous material is typically in the range of 5 mm to 10 mm, but capacitive sensors are often capable of reading through vitreous (or other nonconductive material) up to 12 mm thick.

Figure 2:
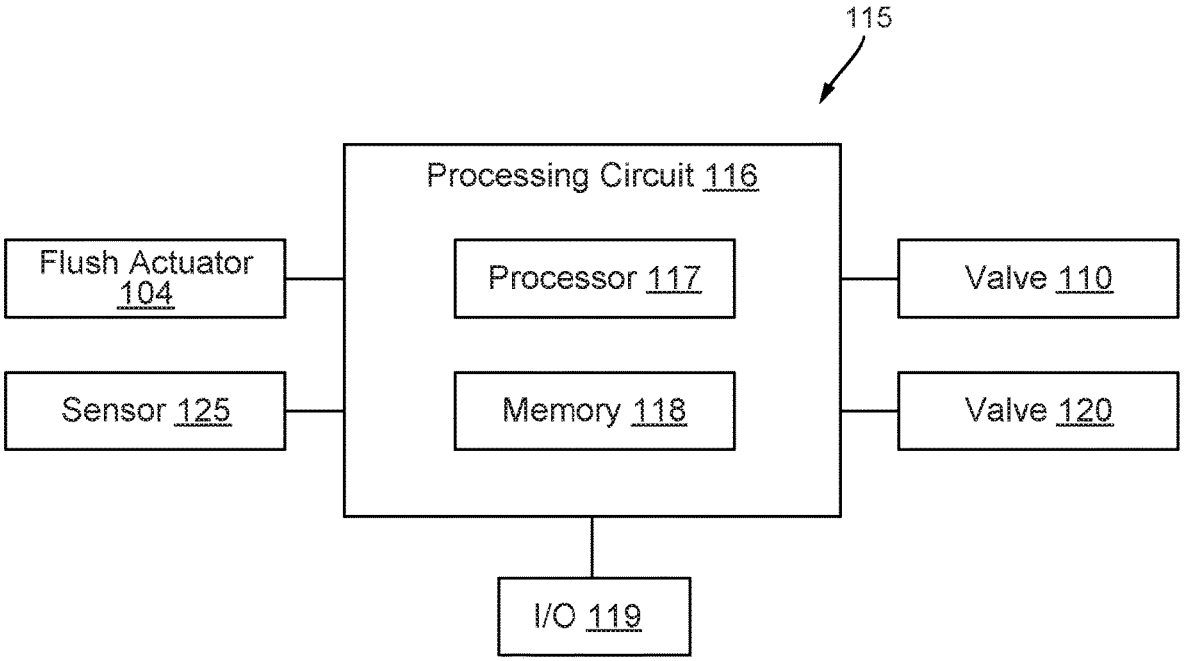
FIG. 2 is a schematic of a control system for the toilet system of FIG. 1.

Referring to FIGS. 1-2, the sensor 125 is operatively coupled to a control system 115 (e.g., controller, etc.). The sensor 125 can, advantageously, indirectly detect the presence of water within the sump 106 during a flush cycle, and provide a corresponding signal to the control system 115 when the water/contents of the bowl 105 and sump 106 have substantially cleared. In response to the signal received from the sensor 125, the control system 115 is configured to control the operation of the first valve 110 and the second valve 120 to selectively control the amount of water provided to the toilet 101, the details of which are described in the paragraphs that follow.

For example, according to the exemplary embodiment shown in FIG. 1, the sensor 125 can detect the presence of water within the sump 106 before a flush cycle is initiated by, for example, detecting a first capacitance value associated with a normal pre-flush water level through a portion of the sump 106, as the sensor 125 is disposed below the normal water level in the sump 106. When a flush cycle is initiated, such as by actuation of a flush actuator 104 by a user (e.g., using a manual trip lever, an electronic touchless actuator, etc.), the control system 115 can instruct the first valve 110 to open for a first predetermined time interval to provide a first flow of water to the rim jet 130, so as to clean the interior of bowl 105. After the first predetermined time interval, the control system 115 can instruct the first valve 110 to close and the second valve 120 to open to provide a second flow of water to the sump jet 140, so as to prime the siphon in the trapway 107. The siphon created in the trapway 107 by the second flow of water from the sump jet 140 can act to move and clear the contents of the bowl 105 through the sump 106 and the trapway 107 toward the sewer. As soon as the contents of the bowl 105 have cleared and the siphon is broken, which can vary based on the contents in the bowl (e.g., solid matter v. liquid matter, etc.), the sensor 125 can detect a second capacitance value associated with a substantially empty sump/bowl through the portion of the sump 106. The sensor 125 can then send a corresponding signal indicating the change of capacitance to the control system 115. In response, the control system 115 can instruct the second valve 120 to close to stop the second flow of water to the sump jet 140 as soon as the control system 115 determines that the siphon has broken and the bowl contents have cleared. In this manner, the toilet system 100 can conserve water by limiting the amount of time the second valve 120 is open based on the minimum amount of water required to initiate the siphon and clear the contents of the bowl 105.

In the event that the sensor 125 is unable to detect the presence of water through the sump 106 or the contents of the bowl 105 are unable to be evacuated (e.g., due to a clog, etc.), the control system 115 is configured to instruct the second valve 120 to close when a maximum allowable volume of water has been directed to the sump jet 140 (e.g., after a predetermined period of time based on flow rate, etc.), so as to further conserve water usage and to comply with applicable building codes. In other words, the toilet system 100 has a dual functionality to conserve water usage by either closing the second valve 120 as soon as the contents of the bowl 105 have been cleared or when the maximum amount of water for the sump jet 140 has been reached. In this manner, water consumption can be reduced without sacrificing flush performance, as compared to other conventional toilet systems.

Referring to FIG. 2, the control system 115 is shown according to an exemplary embodiment. As shown in FIG. 2, the control system 115 includes a processing circuit 116 including a processor 117 and a memory 118. The flush actuator 104, the sensor 125, the first valve 110, and the second valve 120 are each operatively coupled to the processing circuit 116. The control system 115 is configured to receive inputs from the flush actuator 104 and the sensor 125 to control the operation of the first valve 110 and the second valve 120, as explained above. The control system 115 further includes an I/O device, such as a user interface, to provide for status indications or further control of the toilet system 100 for a user.

Figure 3:
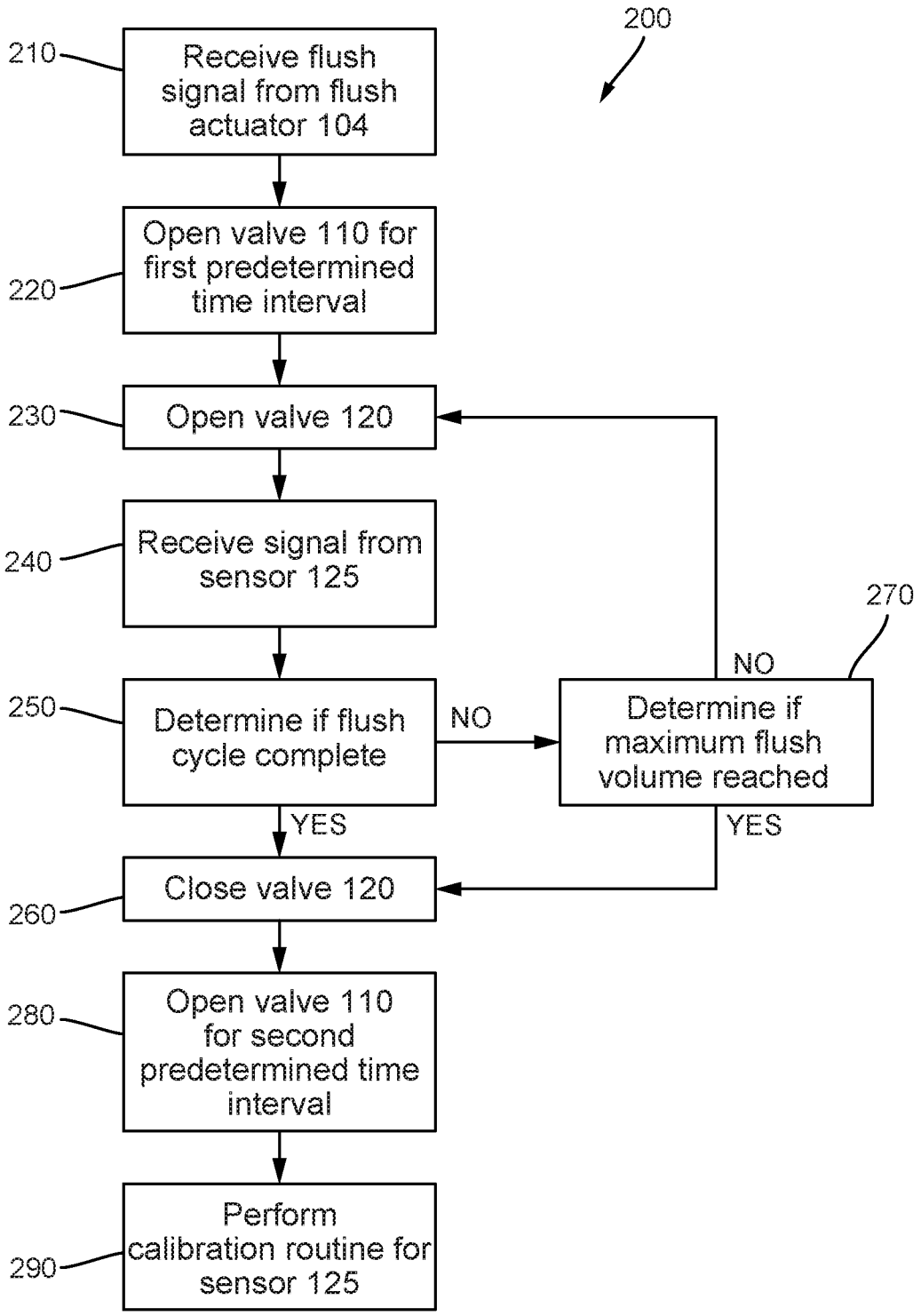
FIG. 3 is a flow chart illustrating a method of controlling a flush function of a tankless siphonic toilet according to an exemplary embodiment.

Referring to FIG. 3, a method of controlling the tankless siphonic toilet 101 is shown according to an exemplary embodiment. In a first step 210, the control system 115 receives a signal from the flush actuator 104 indicating the need to perform a flush cycle. In response to the signal received from the flush actuator 104, the control system 115 instructs the first valve 110 to open for a first predetermined time interval to clean the interior of the bowl 110 at step 220. After the first predetermined time interval, the control system 115 instructs the second valve 120 to open at step 230. At the moment the siphon is broken and the contents of the bowl 105 are substantially cleared, the sensor 125 will detect a change in capacitance through the portion of the sump 106, and will send a corresponding signal to the control system 115 at step 240. In response to the signal received from the sensor 125, the control system 115 determines, at step 250, whether or not the flush cycle has been completed based on the change in capacitance value. If the control system 115 determines that the flush cycle has been completed (i.e., the siphon has broken and the contents of the bowl 105 have substantially cleared), the control system 115 instructs the second valve 120 to close at step 260. If the control system 115 determines that the flush cycle has not completed (i.e., the siphon has not broken and the contents of the bowl 105 have not substantially cleared), the control system 115 determines whether or not a maximum allowable water flush volume has been reached at step 270.

For example, the control system 115 can determine how long the second valve 120 has been open, and based on a given flow rate, the control system 115 can determine the amount of water that has been delivered to the sump jet 140. If the control system 115 determines that a maximum allowable water flush volume has been reached, the control system 115 instructs the second valve 120 to close at step 260. If, however, the control system 115 determines that the maximum allowable water flush volume has not been reached, the control system 115 instructs the second valve 120 to remain open to continue to provide water to the sump jet 140 at step 230. After either the control system 115 determines that the flush cycle has been completed or the maximum allowable water flush volume has been reached, the control system 115 instructs the second valve 120 to close and the first valve 110 to open for a second predetermined time interval to refill the bowl 105 at step 280.

According to an exemplary embodiment, the control system 115 can perform a calibration routine for the sensor 125, such that the sensor 125 can calculate the difference between the first capacitance value associated with a normal pre-flush water level through a portion of the sump 106 before a flush cycle is initiated and the second capacitance value associated with a substantially empty bowl 105/sump 106 at the moment the flush cycle is completed. According to an exemplary embodiment, the calibration routine is performed at initial powering up of the sensor 125, such that all subsequent activity is performed with a calibrated sensor. According to other exemplary embodiments, the calibration routine is performed at any time as part of a diagnostic process for the toilet system 100.

The disclosed toilet system automatically determines and uses only the minimum amount of water necessary to clear the contents of a toilet bowl for a given flush cycle, so as to more effectively reduce water usage, as compared to conventional toilet systems. In addition, the disclosed system is configured such that the toilet can continue to receive water to clear the contents of the bowl until a maximum allowable water flush volume has been reached, so as to further conserve water usage. In this manner, the disclosed toilet system can effectively conserve water usage without any input or decisions from a user, can provide for an infinite number of different flush volumes, can help to comply with applicable building codes, and can act as a failsafe to prevent excess water usage in the event of a sensor failure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. For example, the capacitive sensor may be replaced with a different type of sensor, such as an optical sensor, a float sensor, or any other sensor that can detect the presence of water within the bowl 105 and/or the sump 106. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A system for a toilet having a toilet bowl, a rim jet, a sump jet, and a sump, the system comprising:

a first valve configured to be fluidly coupled to the rim jet;

a second valve configured to be fluidly coupled to the sump jet, the second valve operable between a first position and a second position, the second valve configured to facilitate flow of water from the sump jet to the bowl in the first position and prohibit flow of the water from the sump jet to the bowl in the second position;

a sensor configured to be coupled to the sump and detect a first capacitance value when a first amount of water is in the sump and a second capacitance value when a second amount of water is in the sump, the second amount of water being less than the first amount of water; and a control system operatively coupled to the first valve, the second valve, and the sensor, the control system configured to cause the second valve to transition from the first position to the second position in response to the sensor detecting the second capacitance value.

2. The system of claim 1, wherein the second amount of water is zero.

3. The system of claim 1, wherein the second is configured to be coupled to an exterior surface of the sump and separated from water in the sump by the sump.

4. The system of claim 1, wherein the first valve is operable between a third position and a fourth position, the first valve configured to facilitate flow of water from the rim jet to the bowl in the third position and prohibit flow of water from the rim jet to the bowl in the fourth position.

5. The system of claim 4, wherein the control system is further configured to:

cause the first valve to transition from the third position to the fourth position; and cause the second valve to transition from the second position to the first position in response to the first valve transitioning to the fourth position.

6. The system of claim 4, wherein the control system is further configured to:

initiate a timer in response to at least one of:

the first valve transitioning to the fourth position; or the second valve transitioning to the first position; and transition the second valve from the first position to the second position in response to at least one of:

the sensor detecting the second capacitance value; or the timer exceeding a target period of time.

7. The system of claim 4, wherein the control system is further configured to cause the first valve to transition from the fourth position to the third position after the second valve is transitioned to the second position.

8. A tankless toilet system comprising:

a tankless toilet configured to receive water from a water source, the tankless toilet comprising:

a bowl;

a first supply conduit configured to receive the water from the water source;

a first valve disposed within the first supply conduit;

a rim jet fluidly coupled to the first supply conduit and configured to provide the water to the bowl;

a sump configured to receive the water from the bowl;

a second supply conduit configured to receive the water from the water source separate from the first supply conduit;

a sump jet fluidly coupled to the second supply conduit and configured to provide the water to the sump; and a second valve disposed within the second supply conduit and operable between a first position, where the second valve facilitates flow of the water from the sump jet to the sump, and a second position, where the second valve prohibits flow of the water from the sump jet to the sump; and a sensor coupled to the tankless toilet and configured to detect a first capacitance value when a first amount of the water is in the sump and a second capacitance value when a second amount of the water is in the sump;

a control system operatively coupled to the first valve, the second valve, and the sensor, the control system configured to cause the second valve to transition from the first position to the second position in response to the sensor detecting the second capacitance value;

wherein the second amount of the water is less than the first amount of the water.

9. The tankless toilet system of claim 8, wherein the second amount of the water is zero.

10. The tankless toilet system of claim 9, wherein:

the sump is made from a vitreous material; and the sump has a thickness at a location where the sensor is located, the thickness being between 10 mm and 12 mm, inclusive.

11. The tankless toilet system of claim 8, wherein:

the first valve is operable between a third position, where the first valve facilitates flow of the water from the rim jet to the bowl, and a fourth position, where the first valve prohibits flow of the water from the rim jet to the bowl; and the control system is further configured to:

cause the first valve to transition from the third position to the fourth position; and cause the second valve to transition from the second position to the first position in response to the first valve transitioning to the fourth position.

12. The tankless toilet system of claim 11, wherein the control system is further configured to:

initiate a timer in response to at least one of:

the first valve transitioning to the fourth position; or the second valve transitioning to the first position; and transition the second valve from the first position to the second position in response to at least one of:

the sensor detecting the second capacitance value; or the timer exceeding a target period of time.

13. The tankless toilet system of claim 11, wherein the control system is further configured to cause the first valve to transition from the fourth position to the third position after the second valve is transitioned to the second position.

14. The tankless toilet system of claim 11, further comprising a flush actuator operatively coupled to the control system and configured to initiate a flush cycle and cause the control system to cause the first valve to transition from the third position to the fourth position.

* * * * *